US005248094A

United States Patent [19]

Munoz

[11] Patent Number: 5,248,094

[45] Date of Patent: Sep. 28, 1993

[54] ADJUSTABLE FLUID JET CLEANER

[75] Inventor: Jose P. Munoz, Joplin, Mo.

[73] Assignee: Ingersoll-Rand Company, Woodcliff Lake, N.J.

[21] Appl. No.: 679,279

[22] Filed: Apr. 2, 1991

[51] Int. Cl.[5] ..... B05B 3/02

[52] U.S. Cl. ..... 239/247; 239/550; 239/243; 239/264; 239/225.1; 51/317

[58] Field of Search ..... 239/587, 550, 243, 247, 239/264, 227, 225.1, DIG. 1, 590.3; 83/177; 51/410, 436, 439, 317, 319-321; 134/180, 181

[56] References Cited

U.S. PATENT DOCUMENTS

| | | | |
|---|---|---|---|
| 3,421,702 | 1/1969 | O'Brien | 239/587 |
| 3,471,091 | 10/1969 | Baker | 239/587 |
| 3,895,756 | 7/1975 | Jaeger | 239/227 |
| 3,931,930 | 1/1976 | Waldrum | 239/587 |
| 3,985,303 | 10/1976 | Steimle | 239/428.5 |
| 4,221,336 | 9/1980 | Diamond | 239/587 |
| 4,272,018 | 6/1981 | Hickson | 239/225.1 |
| 4,438,537 | 3/1984 | Bickle | 239/587 |
| 4,555,872 | 12/1985 | Yie | 51/439 |
| 4,596,362 | 6/1986 | Pralle et al. | 239/587 |
| 4,717,078 | 1/1988 | Arp | 239/587 |
| 4,768,709 | 9/1988 | Yie | 239/8 |
| 4,793,557 | 12/1988 | Marchese et al. | 239/587 |
| 4,802,628 | 2/1989 | Dautel et al. | 239/227 |
| 4,832,266 | 5/1989 | Marvin | 51/439 |
| 4,836,455 | 6/1989 | Munoz | 239/590.3 |
| 4,872,615 | 10/1989 | Myers | 239/587 |
| 4,983,109 | 1/1991 | Miller et al. | 239/125 X |
| 5,018,670 | 5/1991 | Chalmers | 51/439 |
| 5,039,013 | 8/1991 | Sawade et al. | 239/DIG. 1 |
| 5,065,551 | 11/1991 | Fraser | 51/410 |

FOREIGN PATENT DOCUMENTS

| | | | |
|---|---|---|---|
| 2910002 | 9/1980 | Fed. Rep. of Germany | 239/225.1 |

*Primary Examiner*—Andres Kashnikow
*Assistant Examiner*—Lesley D. Morris
*Attorney, Agent, or Firm*—Walter C. Vliet; Glenn B. Foster

[57] ABSTRACT

A fluid jet cleaning system includes a nozzle body having an axis. A nozzle is adjustably mounted within the nozzle body, the nozzle disperses fluid streams along a centerline. An adjustment device adjusts a relative position between the centerline and the axis. The adjustment device includes longitudinally extendable rod members, configured to contact the nozzle to restrict motion of the nozzle towards each rod member. This adjustment system may be used in conjunction with regular fluid jet cutting systems or the abrasive cutting jet system. Abrasives are injected into the fluid within a chamber formed in the nozzle.

8 Claims, 3 Drawing Sheets

ADJUSTABLE FLUID JET CLEANER

BACKGROUND OF THE INVENTION

This invention relates generally to fluid jet cleaning systems, and more particularly to a fluid jet which may be adjusted to control the cleaning position and intensity of the device.

In prior fluid jet cleaning systems, the angle at which the fluid jet exits the nozzle body is fixed relative to the body. In these prior art designs, it is often difficult to regulate the cleaning intensity of the system without altering the fluid pressure, orifice size, number of orifices, etc. It is also difficult to precisely locate the fluid jet or jets, as desired relative to the working surface.

The foregoing illustrates limitations known to exist in present fluid jet cleaners. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a fluid jet cleaning system including a nozzle body having an axis. A nozzle is adjustably mounted within the nozzle body, the nozzle disperses fluid streams along a centerline. Adjustment means adjust a relative position between the centerline and the axis.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
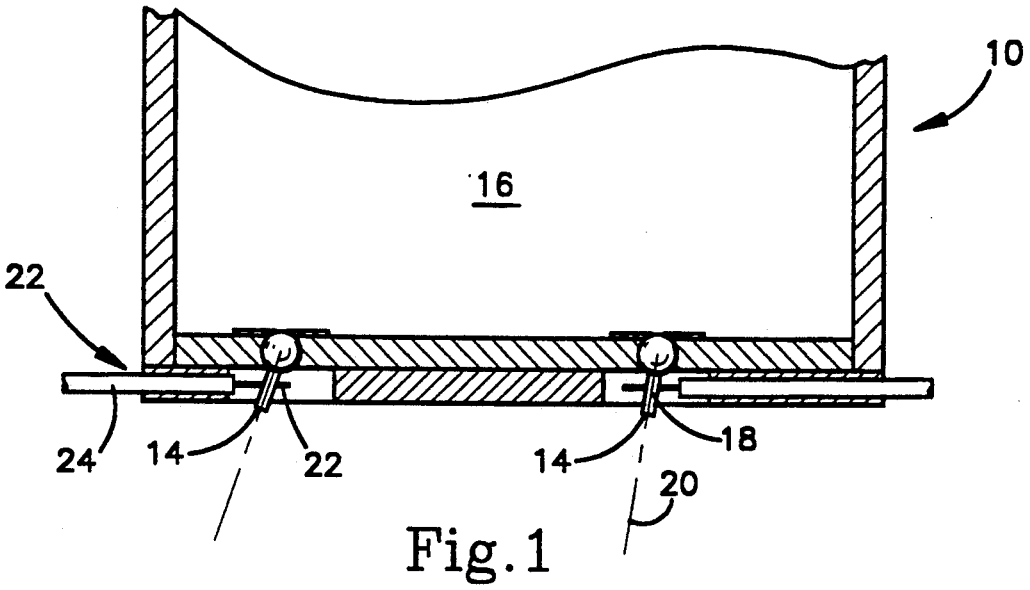
FIG. 1 is a side cross sectional view illustrating an embodiment of fluid jet cleaner of the instant invention.

FIG. 1 illustrates a fluid jet cleaner 10 of the instant invention which includes a nozzle body 12 and a plurality of adjustable nozzles 14 (in this specification, the terms "nozzle" and "nozzle means" will be used interchangeably). This fluid jet cleaner is of the jet fan nozzle type, even though this invention applies to nozzle configurations of other types. The nozzle body 12 forms a reservoir 16 which contains fluid under pressure. The fluid contained within the reservoir is in fluid communication with nozzle apertures 18 formed within the nozzles. Fluid escaping from the reservoir 16 through the nozzle apertures 18 will be projected, for all practical purposes, along a centerline 20.

The nozzle body 12 of the fluid jet cleaner 10, in this embodiment, may or may not be stationary. Adjustment means 22 is included to adjust the centerline direction of each nozzle relative to the nozzle body 12. The adjustment means typically comprises a plurality of radially disposed longitudinally extensible rod members 24, selectively extendable to align the centerline 20 of the each individual nozzle 14. The function of the adjustment means is described in greater detail below.

Figure 2:
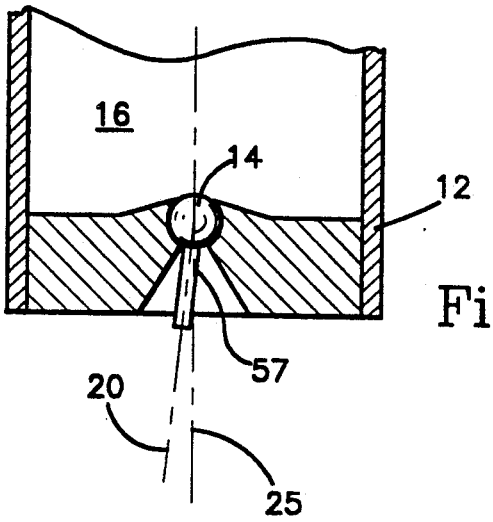
FIG. 2 is a side cross sectional view illustrating an alternate embodiment of fluid jet cleaner of the instant invention.

While the embodiment of FIG. 1 illustrates a nozzle body 12 having a plurality of nozzles 14, it is within the intended scope of the present invention to provide a nozzle body 12 having only one nozzle as illustrated in FIG. 2. In this embodiment, the angular offset of the centerline 20 relative to a reference line 25 of the nozzle body 12 is illustrated.

Figure 3:
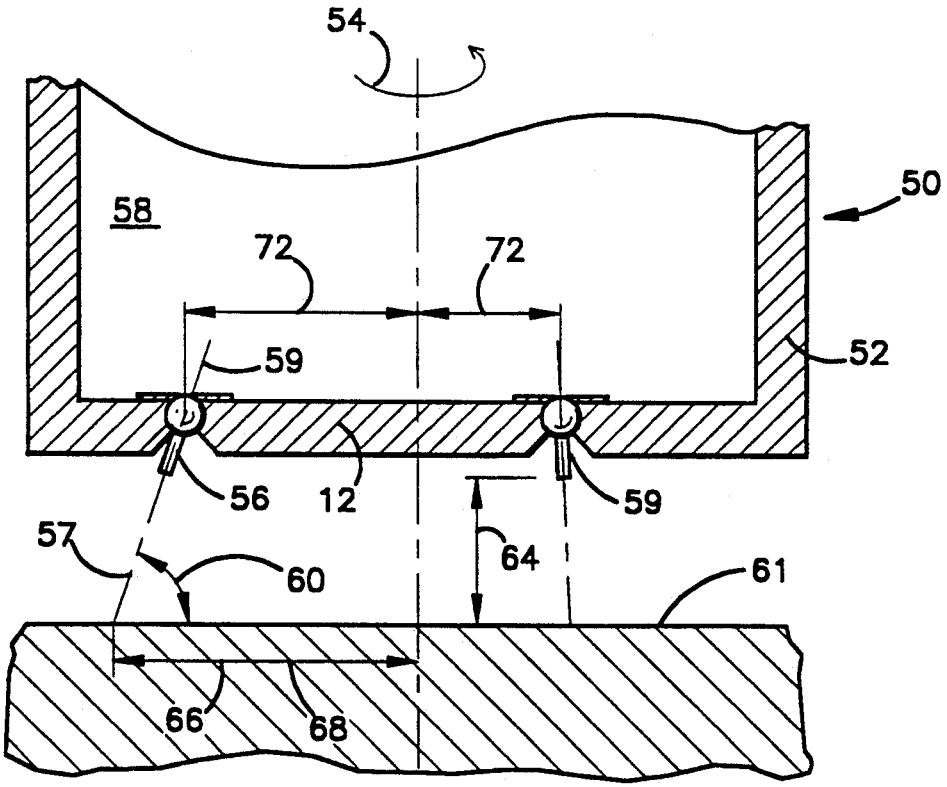
FIG. 3 is a side cross sectional view illustrating yet another alternate embodiment of fluid jet cleaner of the instant invention.
Figure 4:
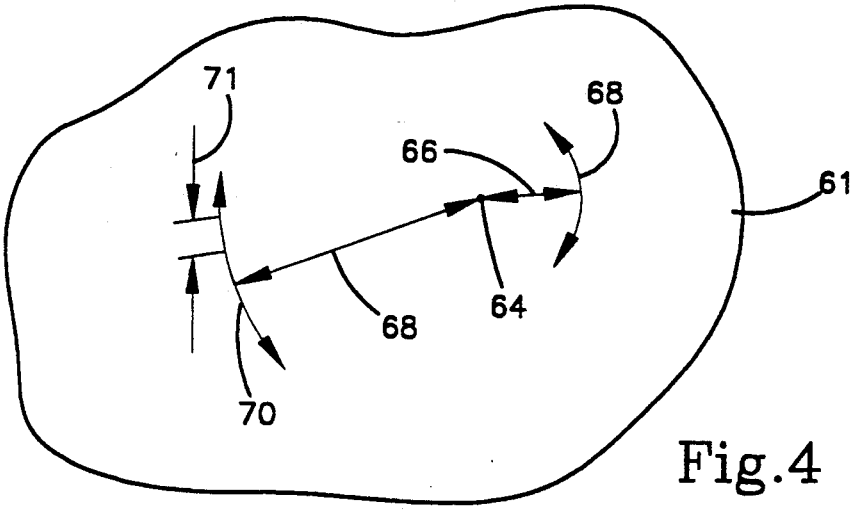
FIG. 4 is a top view of a surface, illustrating the geometries of multiple nozzle fluid jet cleaners acting on the surface.

FIGS. 3 and 4 illustrate an alternate embodiment of fluid jet cleaner 50 which has a nozzle body 52 which may be rotatable about an axis 54. There is at least one nozzle means 56 positioned within the nozzle body to expel fluid along a centerline 57. This approximates the orientation of projection of a fluid stream from the nozzle means 56, as previously described.

To control the cleaning intensity of the fluid jet cleaner 50, the pressure within a reservoir 58 formed in the nozzle body 52 is altered, the angle 60 at which the fluid acts upon a surface 61 to be cleaned is changed, the length 64 which separates the surface 61 along the axis 54 is modified, the number of nozzle means 56 acting on the surface is altered, or the dimensioning of a nozzle orifice 59 is changed. Many of the above controls of the cleaning intensity are cross related.

A distance 66 is measured along the surface 61 from where the axis 54 intersects the surface, to where the centerline 57 intersects the surface. This distance 66 will generate a radius 68 of a cleaning circle 70 when the nozzle body 52 is rotated about the axis 54. The smaller the radius 68 (assuming the nozzle body is rotating at a constant speed) the more time the fluid is acting on a constant length 71 of the cleaning circle 70, and the more intense the cleaning action of a fluid jet will be.

The angle 60 at which the centerline 57 (or fluid stream) intersects the surface will also affect the cleaning intensity since the greater the angle 60, the greater the energy intensity of the fluid jet imparted upon the surface 61 will be.

To alter the angle 60 of the centerline relative to the axis 54 and maintain a constant cleaning circle 70, a nozzle distance 72 (which is the length along the nozzle body, normal to the axial direction, from the axis to the nozzle means 56) must be altered. For this reason, multiple nozzles 56 may be provided with different nozzle distances 72.

Figure 5:
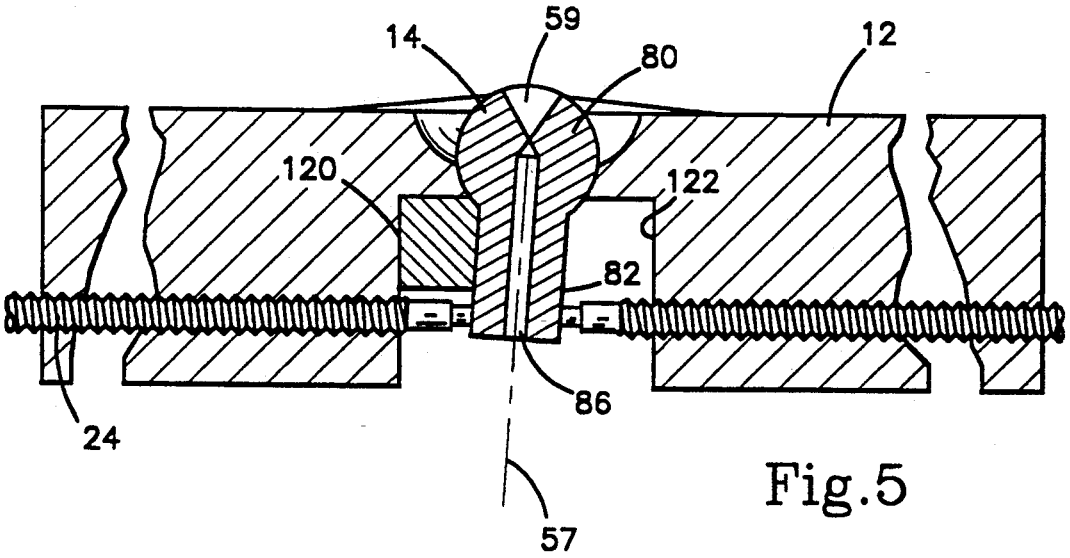
FIG. 5 is a side cross section view of a fluid jet cleaner of the instant invention illustrating the adjustment portion to orient the nozzle means.

The adjustment means used in the instant invention may be any device, which is well known in the art, which adjusts the nozzle stream relative similar to that described in U.S. Pat. No. 4,836,455, (incorporated herein by reference) which discloses using adjustment means for fluid jet systems. The adjustment structure is illustrated in FIG. 5, in which the nozzle or nozzle means 14 includes a body section 80 and a stem portion 82. The nozzle 14 contains a center bore 86 whose orientation determines, for all practical purposes, the orientation of the centerline 57.

To adjust the relative position between the centerline 57 of a nozzle and the nozzle body 12, the radially disposed extensible members 24 are retracted. The stem portion is then aligned as desired, then the radially disposed extensible members 24 are then extended to lock the nozzle into position.

The radially disposed longitudinally extensible rod members 24 are typically set screws. However, they may be any device which extends to lock the nozzle means 14 into a longitudinal direction by acting on a side of nozzle stem 82. Any number of members 24 may be used, even though two to four, substantially evenly spaced in the same plane, have been found optimal. Two radially disposed members 24 are disposed on opposite sides of the nozzle stem 82, the rod members are radially aligned with the axis of rotation (see FIG. 4).

Fluid jets may be aimed in two ways. Initially, the operator may "eyeball" the angle 60 of the centerline by observation. Alternately, as illustrated in FIG. 5, a shim 120 ma be inserted into a nozzle stem recess 122 which the nozzle stem projects into. Actuation of the nozzle stem 82 by the adjustment means, to force the nozzle stem 82 into contact with the shim 120, results in precise and reproducible alignment of the nozzle stem 82 and thereby precise alignment of the centerline 57.

Figure 6:
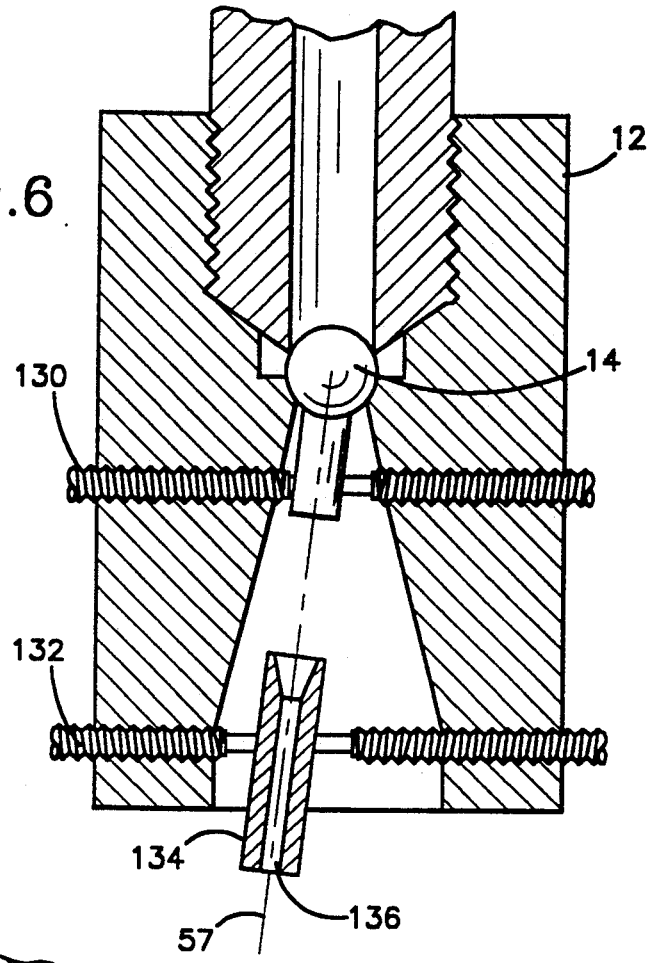
FIG. 6 is a side cross sectional view of a fluid jet cleaner of the present invention, further including an adjustable portion to adjust a section which introduces abrasives to a fluid stream.
Figure 7:
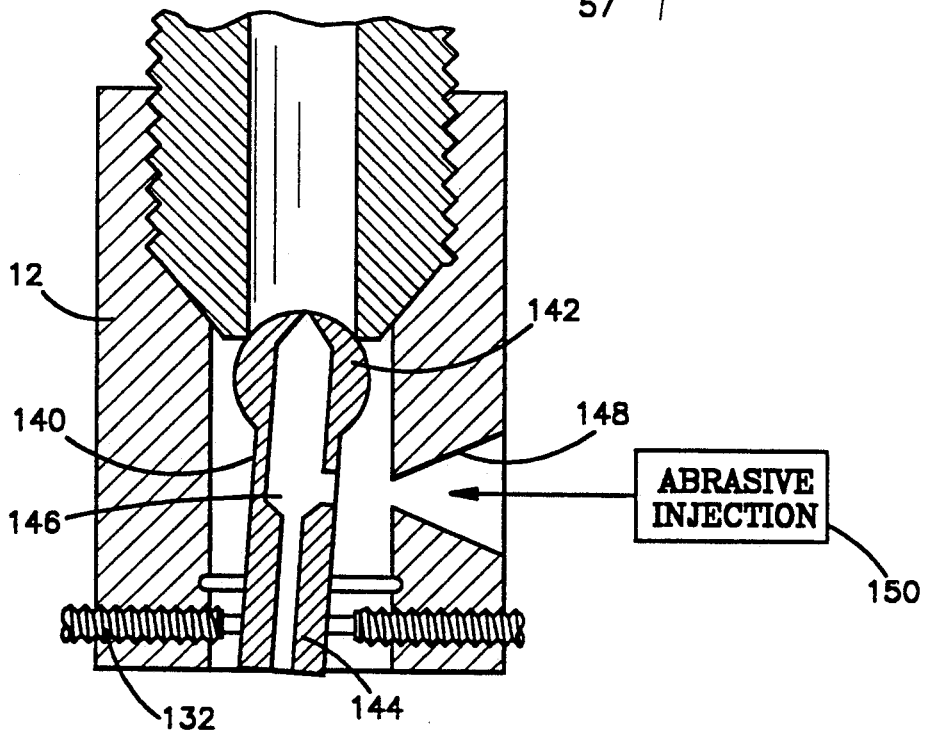
FIG. 7 is a side cross-sectional view o a fluid jet cleaner of the present invention, further including an adjustable portion to adjust a section which introduces abrasives to a fluid stream.

FIGS. 6 and 7 illustrate the application of the adjustability feature to abrasive cleaners. In FIG. 6, a first set of adjustment means 130 angularly position the adjustable nozzle 14. A second adjustment means 132, which may be similar to the adjustment means on the above mentioned U.S. Pat. No. 4,836,455 (as is well known in the art) is applied to a focusing tube 134 to align an opening 136 of the focusing tube 134 with the centerline 57 of the nozzle.

FIG. 7 illustrates an alternate embodiment for focusing an abrasive fluid jet cleaner. A unitary abrasive nozzle structure 140 includes an adjustable nozzle 142 and a focusing tube 144. The entire unitary abrasive nozzle structure 140 may be adjusted by adjustment means 132 as described above. The unitary abrasive structure 140 has a chamber 146 formed therein which receives fluid from the nozzle 142. The chamber 146 communicates, through an aperture 148, to a well known abrasive injection device 150, indicated schematically.

It is to be understood that the above described the preferred embodiments, and are not intended as limitations to the inventive scope of the present disclosure, as set forth in the claims.

Having described the invention, what is claimed is:

1. A fluid jet cleaning system for cleaning a surface comprising:

a nozzle body adapted for continuous rotation about an axis during operation, the nozzle body having a plurality of attachment points located on a surface of the nozzle body;

a plurality of nozzles mounted to the nozzle body at the attachment points, the nozzles being adjustable to disperse fluid along a center line which is at an adjustable angle to the axis, at least one of the plurality of nozzles being mounted on the nozzle body at a distance from the axis different from the distance from the axis at which at least one other nozzle is mounted on the nozzle body so that upon continuous rotation of the nozzle body fluid dispersed from the nozzles will act to clean the surface.

2. Apparatus according to claim 1 further including abrasive injection means for injecting abrasive into the fluid at a position downstream of at least one of the plurality nozzles.

3. The apparatus as described in claim 2, wherein at least one of the plurality of nozzles further includes:

chamber means for receiving the abrasive from the abrasive injection means.

4. The apparatus as described in claim 3 further comprising:

focusing tube means for receiving the fluid after injection of the abrasive into the chamber means.

5. The apparatus as described in claim 4, wherein the nozzle means and the focusing tube means are a unitary structure.

6. The apparatus as described in claim 1, wherein each nozzle further includes:

a nozzle head and a nozzle stem.

7. The apparatus as described in claim 6, further comprising:

at least one longitudinally extendable rod means extendable in a direction longitudinally of the rod member, for contacting the nozzle stem to restrict motion of the nozzle stem towards the rod member.

8. The apparatus as described in claim 1, further comprising:

shim means positionable between the nozzles and the nozzle body for accurately controlling the relative position between the nozzles and the nozzle body.

* * * * *